United States Patent [19]

VanSchaick et al.

[11] Patent Number: 4,663,604

[45] Date of Patent: May 5, 1987

[54] COIL ASSEMBLY AND SUPPORT SYSTEM FOR A TRANSFORMER AND A TRANSFORMER EMPLOYING SAME

[75] Inventors: Thomas E. VanSchaick, Burnt Hills; Morris V. VanDusen, Clifton Park; James M. Anderson, Cohoes, all of N.Y.

[73] Assignee: General Electric Company, Schenectady, N.Y.

[21] Appl. No.: 818,843

[22] Filed: Jan. 14, 1986

[51] Int. Cl.[4] ..... H01F 27/02; H01F 27/30

[52] U.S. Cl. ..... 336/96; 336/62; 336/197; 336/198; 336/205

[58] Field of Search ..... 336/55, 60, 62, 198, 336/208, 96, 205, 206, 197, 185

[56] References Cited

U.S. PATENT DOCUMENTS

| | | | |
|---|---|---|---|
| 2,782,386 | 2/1957 | Cornell | 336/62 |
| 2,904,760 | 9/1959 | Johnston | 336/60 |
| 2,910,663 | 10/1959 | Wilk et al. | 336/60 X |
| 3,201,728 | 8/1965 | McWhirter | 336/205 X |
| 3,233,311 | 2/1966 | Giegerich et al. | 336/96 X |
| 3,346,828 | 10/1967 | Buschman | 336/197 X |
| 3,668,583 | 6/1972 | Nichols | 336/60 X |
| 3,720,897 | 3/1973 | Feather et al. | 336/60 |
| 3,878,492 | 4/1975 | Tjernsteom | 336/62 |
| 4,105,984 | 8/1978 | Smith et al. | 336/60 |

FOREIGN PATENT DOCUMENTS

| | | | |
|---|---|---|---|
| 101724 | 1/1980 | Japan | 336/96 |
| 71012 | 5/1980 | Japan | 336/205 |

*Primary Examiner*—Thomas J. Kozma

*Attorney, Agent, or Firm*—Jerome C. Squillaro

[57] ABSTRACT

A coil assembly includes a first winding for circumferentially surrounding at least a portion of a leg of a transformer core, a second winding spaced from and circumferentially surrounding at least a portion of the first winding, first supports, such as axially extending insulative rods, disposed between the first and second winding, for inhibiting axial motion of the second winding relative to the first winding and a second support disposed about at least a portion of the outer periphery of the second winding for inhibiting radial motion of the second winding relative to the first winding. Encapsulating material, such as an epoxy resin having glass fibers disposed therethrough, is disposed between the first winding and the leg, between the first and second winding and disposed about the second support for forming a monolithic structure. In a transformer including such a coil assembly, the leg and conductors forming the windings may be fluid cooled. In a method for forming a coil assembly, the encapsulating material is flowed from the bottom of the assembly to fill spaces and to avoid formation of bubbles therein before curing.

2 Claims, 5 Drawing Figures

COIL ASSEMBLY AND SUPPORT SYSTEM FOR A TRANSFORMER AND A TRANSFORMER EMPLOYING SAME

BACKGROUND OF THE INVENTION

The present invention relates to a coil support system for a transformer and, more particularly, to a coil assembly and support system wherein the conductors forming the primary and secondary windings, or coils, of the transformer are concentrically wound around a section, or leg, of the core of the transformer and encapsulated to form a monolithic structure.

In one particular class of transformer, a pair of a respective plurality of transposed hollow strand conductors, which are typically fabricated from copper and through which fluid may be circulated for cooling the conductors, are cylindrically, concentrically wound around and spirally extend along a core section, or leg, of the transformer to form respective radially spaced apart primary and secondary windings of the transformer. The actual designation of the primary and secondary winding is determined by electrical connections to the windings. For the present invention, it is immaterial which winding is actually the primary and which winding is actually the secondary.

A generally odd number of conductors are transposed to form a winding in order to reduce the effect of leakage flux on anyone conductor. The present invention applies to all windings of a transformer regardless if one or a plurality of conductors form the winding and further regardless if the conductors forming the winding are hollow to permit circulation of coolant fluid therethrough, or solid.

After the conductors are wound around the leg of the core, they must be sufficiently supported both radially and axially to resist and withstand forces due to a fault (such as a sudden short circuit applied at the terminals of either winding) that causes a significant increase in electrical current in the windings. Such a fault generates forces that attempt to radially inwardly collapse the radial inner winding and radially outwardly burst the radial outer winding. The magnitude of the collapsing and/or bursting force depends on the magnitude of the current generated by the fault, the number of turns in the winding and the ratio of the coil diameter to the coil height. In addition, axial misalignment between the windings will cause current due to the fault to generate axial forces that tend to apply a shear effect (i.e. substantially parallel to the longitudinal axis of the windings) on the interwinding supports. The magnitude of the axial, or shear, force depends on the degree of axial misalignment between the windings and the magnitude of the current generated by the fault.

Additionally, for efficient transformer operation, the support system must be able to accommodate thermal forces from coil temperatures above ambient expected during operation due to $I^2R$ losses in the conductors, from eddy currents and hysteresis losses in the core, and from stray flux impinging the axial ends of the windings. Further, the support system must restrain vibratory forces during operation. In certain transformers, the elements of the core of the transformer are fabricated from a plurality of laminations. As is well known, laminations of the core of a transformer are subject to vibratory forces between the laminations during operation due to electrical currents, such as eddy currents, induced in the laminations by the magnetic flux of the transformer, which result in magnetostrictive forces within the core. The support system must satisfactorily restrain, resist and withstand all these forces over long term operation, yet be easily and readily fabricated in order to minimize cost.

One transformer of the type addressed by the present invention is a liquid cooled transformer which may be used, for example, in the excitation system of a large dynamoelectric machine. Such an excitation system and associated transformer is described in a copending application entitled, "Liquid Cooled Static Excitation System For A Dynamoelectric Machine", having Ser. No. 776,331, filed on Sept. 16, 1985, and assigned to the present assignee. It is expected that the present invention may be most beneficially applied to transformers having a rating from about 3000 KVA to about 10,000 KVA. However, expression of ratings is not intended to limit application of the invention. In a generator of this category, a typical operating temperature rise of about 15° C. over a water coolant input temperature of about 45° C. may be experienced.

Accordingly, it is an object of the present invention to provide a coil support system for a transformer wherein the coil support system provides both radial and axial support to the coils forming primary and secondary windings of the transformer adequate to restrain and withstand forces due to a fault, such as a sudden short circuit applied at the terminals of a winding.

Another object of the present invention is to provide a coil support system that is able to accommodate thermal forces from coil temperatures above ambient expected during operation.

Yet another object of the present invention is to provide a coil support system that restrains and withstands vibratory forces on the laminations of the core of the transformer during operation.

SUMMARY OF THE INVENTION

In accordance with the present invention, a coil assembly for a transformer having a core, the core including at least one leg having a longitudinal axis, comprises first winding means spaced from and circumferentially surrounding at least a portion of the leg, second winding means spaced from and circumferentially surrounding at least a portion of the first winding means, first support means, such as axially extending insulative rods, disposed between the first and second winding means for inhibiting relative axial motion between the first and second winding means, second support means disposed about at least a portion of the outer periphery of the second winding means for inhibiting radial motion of the second winding means relative to the first winding means, and first, second and third encapsulation means respectively disposed between the leg and first winding means, the first and second winding means and about the outer periphery of the second support means, such that a monolithic structure including the first and second winding means, first and second support means, and first, second and third encapsulation means is formed.

In accordance with another aspect of the present invention, a method for fabricating a coil assembly for a transformer having a core, the core including a leg having a longitudinal axis, comprises assembling the first and second winding means, and first and second support means of the coil assembly about the leg and respectively disposing first and second encapsulation means, such as a curable resin, from the lower portion of the assembly between the first winding and the leg, and between the first and second winding when the longitudinal axis of the leg is substantially vertically disposed. Glass fibers may be disposed through the resin before curing. A third encapsulation means, such as a curable resin, is disposed around the second winding and second support means and impregnates the second support means.

In accordance with yet another aspect of the invention, a transformer comprises a core having at least one leg, first winding means circumferentially surrounding at least a portion of the leg, second winding means spaced from and circumferentially surrounding at least a portion of the first winding means, first support means disposed between the first and second winding means for inhibiting relative axial motion between the first and second winding means, second support means disposed about at least a portion of the outer perihery of the second winding means for inhibiting radial motion of the second winding means relative to the first winding means and first, second and third encapsulation means respectively disposed between the leg and the first winding means, the first and second winding means, and about the outer periphery of the second support means, such that a monolithic structure including the leg, first and second winding means, first and second support means, and first, second and third encapsulation means is formed. The first and second winding means may respectively include a hollow electrical conductor or a respective plurality of transposed hollow conductors for receiving coolant fluid for cooling the conductors. The transformer may further include heat exchange means in heat flow communication with at least the leg for cooling the leg.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

DETAILED DESCRIPTION

Figure 1:
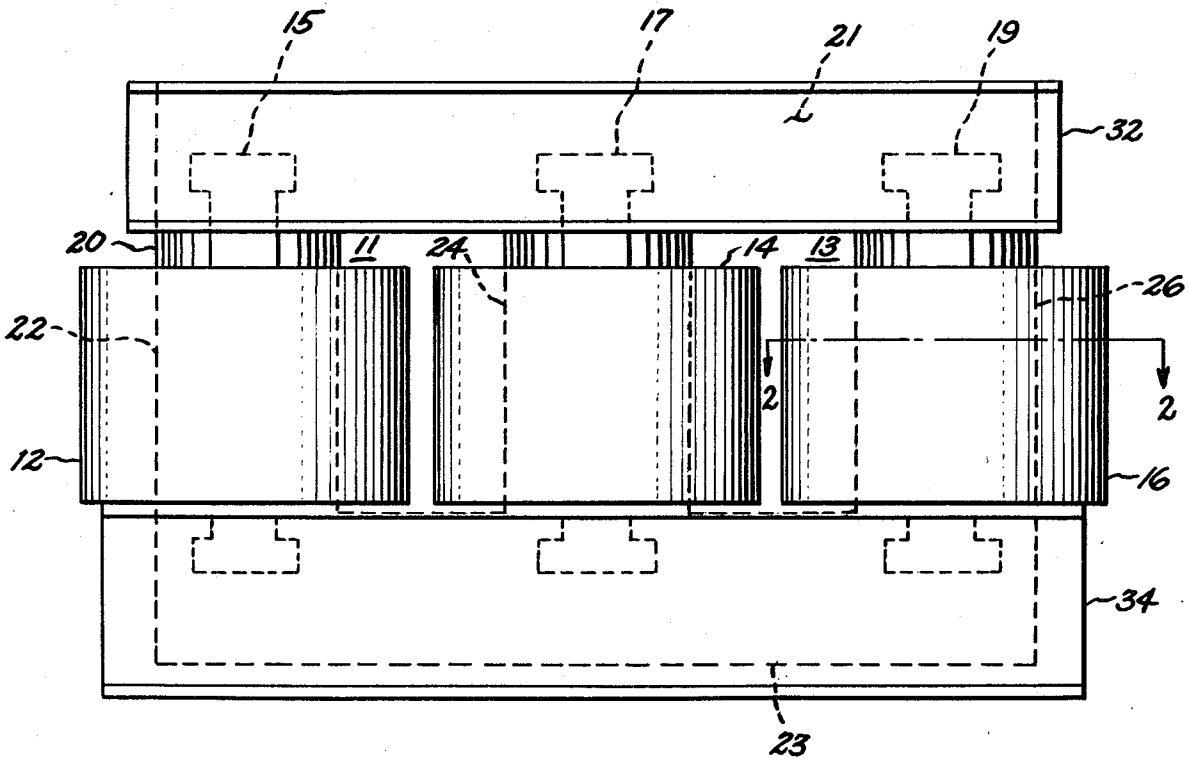
FIG. 1 is an elevational view of a transformer having a coil support system in accordance with the present invention.

Referring to FIG. 1, a transformer including a coil support system in accordance with the present invention is shown (mold 46 is removed for clarity and ease of understanding). The illustrated transformer is a three phase transformer having coils 12, 14 and 16. It is to be understood that the present invention is applicable to transformers having any number of coils, such as, for example, a single phase transformer. Coils 12, 14, and 16, respectively surround at least a portion of and are disposed in magnetic flux communication with legs 22, 24 and 26 of a core 20 of the transformer. Respective ends of legs 22, 24 and 26 are connected by yokes 21 and 23 of core 20. As is generally recognized in the art, core 20 comprises a plurality of metallic laminations appropriately shaped registered and stacked to form legs 22, 24 and 26 and yokes 21 and 23 while avoiding seam concurrence of the laminations. The laminations collectively define the primary magnetic flux path in the transformer. The laminations of core 20 are registered to form windows 11 and 13, bounded by legs 22 and 24, and 24 and 26, respectively, and leg yokes 21 and 23 for receiving portions of coils 12, 14 and 16. A pair of clamping channels, one of which is shown at 32, and another pair of clamping channels, one of which is shown at 34, have yokes 21 and 23 respectively disposed therebetween. Clamping channels 32 and 34 are forcibly held together so that the laminations of yokes 21 and 23 are respectively tightly secured therebetween. A respective pair of support plates 15, 17 and 19 are disposed between legs 22, 24 and 26 and clamping channels 32 and 34. The tee-shaped ends of support plates 15, 17 and 19 are fitted into respective recesses in clamping channels 32 and 34 to enable the entire transformer to be lifted at clamping channels 32 without disrupting the relative positioning of the laminations, coils 12, 14 and 16, or clamping channels 34.

Figures 2, 3A, 3B, 3C:
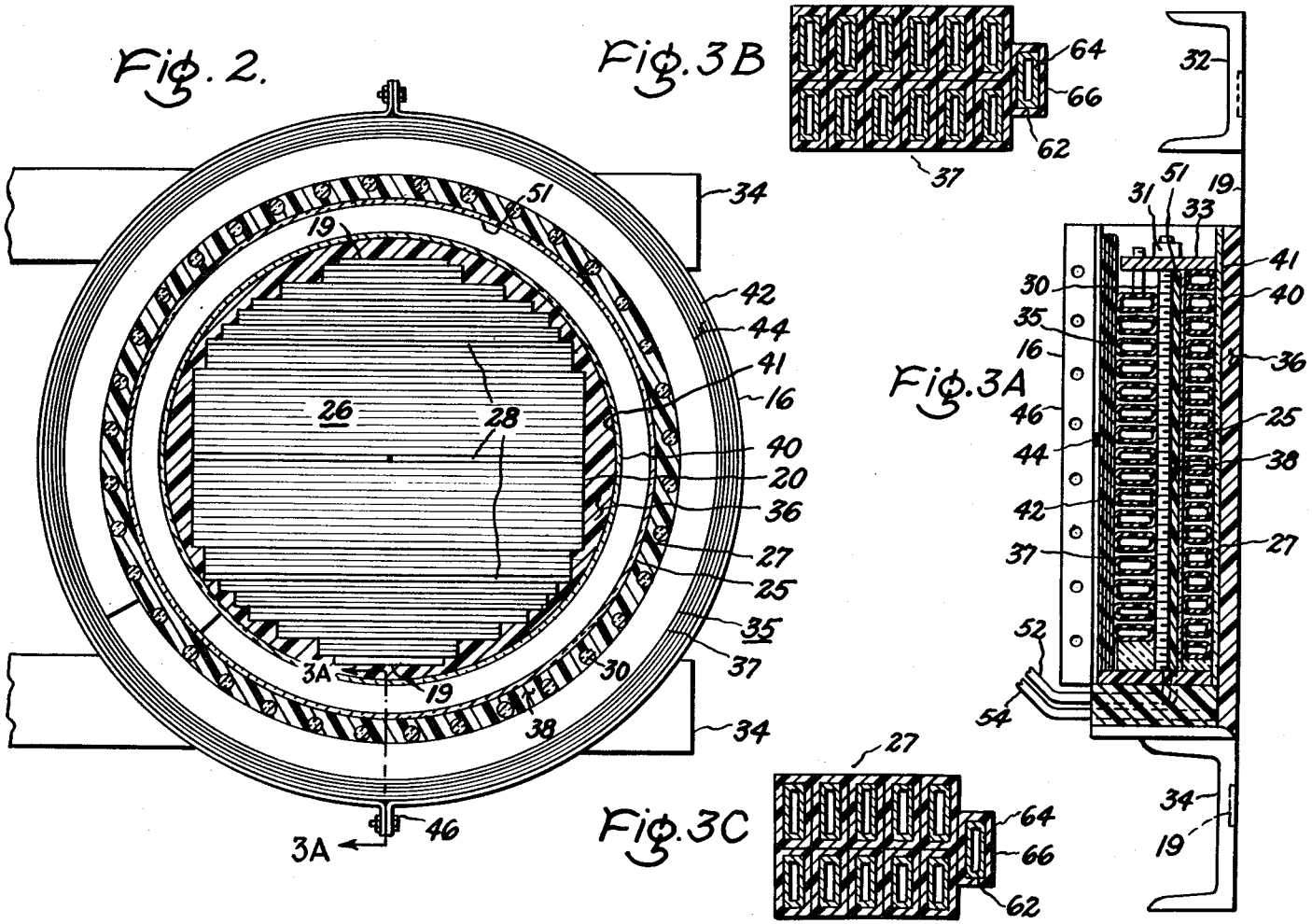
FIG. 2 is a view looking in the direction of the arrows of line 2—2 of FIG. 1.
FIG. 3A is a view looking in the direction of the arrows of line 3—3 of FIG. 2.
FIG. 3B is an enlarged cross-sectional view of conductor 37 shown in FIG. 3A.
FIG. 3C is an enlarged cross-sectional view of conductor 27 shown in FIG. 3A.

Referring to FIG. 2, a view looking in the directions of the arrows of line 2—2 of FIG. 1 is shown. Although the coil support system for coil 16 is shown in detail, it is to be understood that coil support systems for coils 12 and 14 may be analogously fabricated. The plurality of laminations forming leg 26 of core 20 of the transformer are appropriately stacked and sized so that a maximum amount of metal from the laminations may be included within a generally cylindrical enclosure. Shown interspersed between laminations forming leg 26 (and yokes 21 and 23) of the transformer, and disposed in heat flow communication therewith, is a plurality of liquid coolant, such as water, containment vessels 28 (three of which are illustrated) for appropriately confining the liquid coolant and cooling core 20.

Circumferentially surrounding and spaced from leg 26 is a winding drum 40 having an inner surface 41. Winding drum 40 may be fabricated from an insulative material, such as glass fibers. Filling the space between leg 26 and winding drum 40 is an electrically insulative encapsulation means 36, such as an epoxy resin/glass fiber composite material. Circumferentially surrounding the outer periphery of winding drum 40 is a portion of a conductor 27, which is disposed around winding drum 40 and overlays another portion of conductor 27 so that conductor 27 axially spirally extends along the longitudinal axis of winding drum 40 to form a primary winding 25. Winding drum 40 may be used as a mandrel for winding conductor 27. Support means 51 (not necessarily shown to scale), such as glass cloth, is wound around winding 25 to form a plurality of overlapping layers. Glass cloth 51 is firmly circumferentially disposed, but not so tight as to overstretch glass cloth 51 about the periphery of primary winding 25. Radially spaced from and circumferentially surrounding primary winding 25 is a portion of a conductor 37, which overlays another portion of conductor 37 so that conductor 37 axially spirally extends along the longitudinal axis of primary winding 25 to form a secondary winding 35. It is to be understood that the designations "primary" and "secondary" for windings 25 and 35 are for convenience and that the actual primary and secondary winding is determined by electrical connections to the transformer in the circuit in which it is used. A plurality of arcuately spaced apart, axially extending support means, such as rods, 30 are disposed in the space between primary winding 25 and secondary winding 35. Rods 30 are disposed such that their longitudinal axes are substantially parallel to the longitudinal axis of leg 26. Rods 30 preferably comprise a non-electrically conductive, or electrically insulative, material, such as a fiber reinforced resin composite, wherein the fiber may include glass, aramid or cotton and the resin may include epoxy, phenolic or polyester. The space between primary winding 25 and secondary winding 35 is filled with an electrically insulative encapsulation means 38, such as an epoxy resin/glass fiber composite material. Rods 30 cooperate with encapsulation means 38, as explained in detail below, to provide axial support for windings 25 and 35. Rods 30 also form a mandrel-like structure about which conductor 37 may be wound during fabrication of winding 35.

Additional support means 42 (not necessarily shown to scale), such as glass cloth that is wound around the radial outer periphery of winding 35 (but not so tight as to overstretch the glass cloth) to form a plurality of overlapping layers, are firmly circumferentially disposed about the periphery of secondary winding 35 for restraining secondary winding 35 from expanding in an outward radial direction should a fault, such as short circuit, occur in the secondary winding electrical circuit. The glass cloth or other material that may constitute support means 42 and 51 should have a high tensile strength and be non-metallic, non-conducting and compatible with encapsulation means 38 and 44, respectively. A mold 46 which may be fabricated in sections for ease of assembly and removal, is radially spaced from and circumferentially surrounds the outer periphery of secondary winding 35 and support means 42. It is preferred that mold 46 be transparent so that uniform filling of spaces with the coil assembly during introduction of encapsulation means 36, 38 and 44 may be observed. An electrically insulative encapsulation means 44, such as an epoxy resin/glass fiber composite material, is disposed in the space between support means 42 and mold 46. After encapsulation means 36, 38 and 44 are cured and hardened, mold 46, which is fabricated from a material compatible with encapsulation means 44, may be removed, if desired.

Referring to FIG. 3A, a view looking in the direction of the arrows of line 3—3 of FIG. 2 is shown.

Conductors 27 and 37 are shown as single, hollow conductors, respectively. It is preferrable that conductors 27 and 37 comprise a plurality (typically odd) of transposed conductors 62, each having a hollow 64 for receiving coolant fluid and insulation 66 around the outer periphery thereof as is shown in FIGS. 3C and 3B, respectively. As shown in FIGS. 3C and 3B, conductor 27 comprises eleven individual transposed conductors 62 bundled together and conductor 37 comprises thirteen individual transposed conductors 62 bundled together. Conductor 27 and/or conductor 37 may additionally be surrounded by insulation if desired.

During fabrication of the transformer and after assembly of leg 26, winding drum 40, primary winding 25, support means 30, secondary winding 35, support means 42 and mold 46, encapsulation means 36, in a liquid or flowable state, is delivered to the space between leg 26 and winding drum 40 and encapsulation means 38, in a liquid or flowable state, is supplied to the space between primary winding 25 and secondary winding 35. Encapsulation means 36 and 38, which may comprise the same material and are respectively compatible with other components of the transformer and coil support system which they contact, fill the spaces between windings 25 and 35, leg 26 and drum 40 and fill interturn spaces of windings 25 and 35. After filling the spaces to the top of windings 25 and 35, encapsulation means 36 and 38 are cured so that they harden to a solid state. Curing may be accelerated by addition of heat, such as by passing electric current through windings 25 and 35 or by disposing the coil assembly within an oven. After curing, hardened encapsulation means 36 and 38 form a monolithic structure including leg 26, primary winding 25, secondary winding 35, winding drum 40 and support means 30. The monolithic structure restrains and withstands vibratory forces on the laminations of core 20 of the transformer during operation of the transformer.

In addition, during fabrication of the transformer, the space between mold 46 and support means 42 is likewise filled with encapsulation means 44 (in a liquid or flowable state), which may comprise an epoxy resin/glass fiber composite material and which may be the same material as encapsulation means 36 and/or 38. Encapsulation means 44 is then cured and hardened. Encapsulation means 44 may be cured and hardened concurrently with encapsulation means 36 and 38. Encapsulation means 44 is compatible with components of the transformer and support system which it contacts. Further, encapsulation means 44 impregnates and saturates support means 42 to form additional resistance to outward radial forces on winding 35. Criteria for determining the thickness of encapsulation means 44 include the ability of winding 35 to resist outward radial motion by itself and the ability of coil 16 to withstand a predetermined overload per unit (i.e. multiple factor of rated current when the transformer is operating at rated voltage), such as ten, sudden short circuit without radial motion of coil 35 or any adverse effects on encapsulation means 36, 38 and/or 44.

In order to achieve another desirable feature of the present invention, disassembly means includes inner surface 41 of winding drum 40, wherein surface 41 is coated with a material, such as polytetrafluorethylene, available under the trademark Teflon or Poly Vinyl Fluoride, available under the trademark Tedlar, having little affinity for encapsulation means 36. This coating permits primary and secondary windings 25 and 35, support means 30 and 42, encapsulation means 38 and 44 and winding drum 40, to be removed from encapsulation means 36 and leg 26, without destroying the configuration of coils 12 and 14, should it be necessary to replace primary and/or secondary winding 25 and 35 or other components of the coil support system of coil 16. The disassembly means may also include a thin sheet of material (not shown) interposed between encapsulation means 36 and winding drum 40, wherein the sheet of material has little affinity for encapsulation means 36.

A clamping ring 33 overlays the uppermost turn of conductor 27 of primary winding 25 and uppermost turn of conductor 37 of secondary winding 35 and compressibly axially forces respective conductors 27 and 37 of primary winding 25 and secondary winding 35 together, such as by securing a fastening means 31, like a nut, onto a threaded extension of support means 30. Also, the outer periphery of support means 30 is roughened, such as by having external threads, or axially spaced apart circumferential grooves, along the axial length thereof, for providing an appropriate surface for adhesion and purchase of encapsulation means 38. Adhesion of encapsulation means 38 along support means 30 prevents axial motion of winding 25 with respect to winding 35 after encapsulation means 38 is cured, since encapsulation means 38 is permitted to flow between the overlaying turns of conductors 27 and 37 of windings 25 and 35, respectively, before being cured.

During assembly of the transformer, laminations of leg 26 may be disposed within winding drum 40 so that it is not necessary that winding drum 40 include a seam. Conductor 27 is wound around winding drum 40, using it as a mandrel, to form winding 25 and rods 30 are assembled. Support means 51 is disposed around winding 25. Conductor 37 is wound around rods 30 to form winding 35, using rods 30 as a guide or mandrel. Support means 42 is disposed around winding 35 and mold 46 is radially spaced from and disposed around support means 42.

Spaces between winding drum 40 and leg 26, winding 25 and 35, and support means 42 and mold 46 are filled with loosely packed dry chopped glass fiber, preferably having a length of about one-eighth inch and a diameter of about 0.010 inches, for enhancing the strength of the curable resin, to be respectively delivered to the spaces to form encapsulation means 36, 38 and 44, respectively. Thus encapsulation means 36, 38 and 44, which are formed in situ, comprise resin saturated glass fibers that preferably form a homogeneous mixture having glass fibers uniformly dispersed throughout the resin. The resin also impregnates support means 42 and 51 and adheres to support means 30. The glass fibers will generally have a random orientation within the cured resin. Desired characteristics of the resin include compatability with glass fiber and with components of the support system, low volume shrinkage during curing and adequate gel or curing time to permit complete flooding of the coil support system and glass fibers before hardening. Alternatively, glass fibers may be mixed with the resin before the resin is introduced into the coil assembly, although for certain applications this may result in a mixture that is too thick to adequately flow and/or in segregation of the glass fibers during curing.

It is anticipated that due to the monolithic structure created by encapsulating the windings and other portions of the transformer in accordance with the present invention, and further due to the relatively low heat conduction capacity expected from any appropriate encapsulation means 36, 38 and 44 to be used, that internal cooling of at least legs 22, 24 and 26 of core 20 will be required during most transformer applications. However, the present invention is also applicable to transformers whenever it is deemed not necessary to internally cool at least a portion of the core.

Thus has been illustrated and described a coil support system for a transformer wherein the coil support system provides both radial and axial support to the conductors forming windings of the transformer, and wherein the support is adequate to restrain and resist forces due to a fault. Further, a coil support system for a transformer, wherein the coil support system is able to accommodate thermal forces, and restrain and resist vibratory forces of the laminations of the core of the transformer has been shown and described.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. A transformer having a core and coil assembly, the core including at least one leg and the coil assembly comprising:

a first coil winding spaced from and circumferentially surrounding at least a portion of the leg, said first coil winding formed about a winding drum;

a second coil winding spaced from and circumferentially surrounding at least a portion of said first winding;

first support means disposed between the first and second windings, said first support means comprising an annular array of spaced apart rods and at least on clamping ring fastened to the spaced apart rods whereby relative axial motion between the first and second windings is restrained;

second support means disposed about at least a portion of the outer periphery of the second winding, said second support means comprising a glass cloth winding for restraining movement in the radially outer direction;

first encapsulation means contained between the leg and the inner surface of the winding drum, said first encapsulation means comprising resin saturated glass fibers;

second encapsulation means disposed between the first and second windings, said second encapsulation means enveloping at least a portion of each of said spaced apart support rods and said second encapsulation means comprising resin saturated glass fibers; and third encapsulation means disposed around the outer periphery of said second support means, said third encapsulation means comprising resin saturated glass fibers such that a monolithic structure including the first and second windings, the first and second support means and the first, second and third encapsulation means is formed.

2. The transformer recited in claim 1 wherein the winding drum inner surface is coated with a polytetrafluorethylene material for allowing removal of the first and second windings, first and second support means, and the second and third encapsulation means without damaging the first encapsulation means and the leg.

* * * * *